US008500479B2

(12) United States Patent
Sun

(10) Patent No.: US 8,500,479 B2
(45) Date of Patent: Aug. 6, 2013

(54) CABLE CONNECTOR ASSEMBLY FOR CONNECTING HARD DISK DRIVE

(75) Inventor: Zheng-Heng Sun, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 60 days.

(21) Appl. No.: 13/237,946

(22) Filed: Sep. 21, 2011

(65) Prior Publication Data

US 2012/0231649 A1 Sep. 13, 2012

(30) Foreign Application Priority Data

Mar. 11, 2011 (CN) ..... 2011 1 0058732

(51) Int. Cl.
*H01R 4/50* (2006.01)

(52) U.S. Cl.
USPC ..... 439/345; 439/545

(58) Field of Classification Search
USPC ..... 439/345, 247, 545
See application file for complete search history.

(56) References Cited

U.S. PATENT DOCUMENTS 6,945,816 B1 * 9/2005 Wu ..... 439/545
7,575,472 B1 * 8/2009 Wu ..... 439/545
7,607,930 B1 * 10/2009 Wu ..... 439/247
7,670,154 B2 * 3/2010 Yu et al. ..... 439/98
7,794,273 B2 * 9/2010 Xu et al. ..... 439/555
7,798,834 B2 * 9/2010 Wu ..... 439/247
7,931,496 B2 * 4/2011 Ushiro et al. ..... 439/557
7,967,624 B2 * 6/2011 Wang et al. ..... 439/248
8,353,720 B2 * 1/2013 Sun ..... 439/368
2006/0291181 A1 * 12/2006 Sun ..... 361/802
2012/0252257 A1 * 10/2012 Sun ..... 439/368

* cited by examiner

*Primary Examiner* — Amy Cohen Johnson
*Assistant Examiner* — Vladimir Imas
(74) *Attorney, Agent, or Firm* — Altis Law Group, Inc.

(57) ABSTRACT

A cable connector assembly includes a first cable connector, a second cable connector, a locking member, and a retaining frame. The first cable connector includes a first base portion. The second cable connector includes a second base portion. The retaining frame includes a front wall. The front wall defines a mounting hole. The first base portion and the second base portion are received in the mounting hole with the second base portion contacted to the first base portion. The locking member is detachably mounted in the mounting hole at one side of the second base portion. When the locking member is slid to the second base portion and pressing on the second base portion, the second base portion presses on the first base portion. The first base portion and the second base portion are locked in the mounting hole.

15 Claims, 6 Drawing Sheets

CABLE CONNECTOR ASSEMBLY FOR CONNECTING HARD DISK DRIVE

BACKGROUND

1. Technical Field

The present disclosure relates to cable connector assemblies and, particularly, to a cable connector assembly for connecting a hard disk drive (HDD).

2. Description of Related Art

Many HDDs are fixed to a frame and connected to a motherboard through a cable connector. The cable connector includes a connector, a plurality of power cables, and a plurality of data cables. The connector is fixed to the frame with screws and includes a plurality of contact terminals for connecting to the HDD. The power cables and the data cables are connected to corresponding contact terminals respectively for transmitting power and data between the motherboard and the HDD. However, the connectors need to be replaced if the contact terminals corresponding to the power cables or to the data cables are broken. This increases the cost of connectors. It is also inconvenient to assemble or disassemble the connector using screws.

What is needed therefore is a disclosure, which can overcome the limitations described.

DETAILED DESCRIPTION

Figure 1:
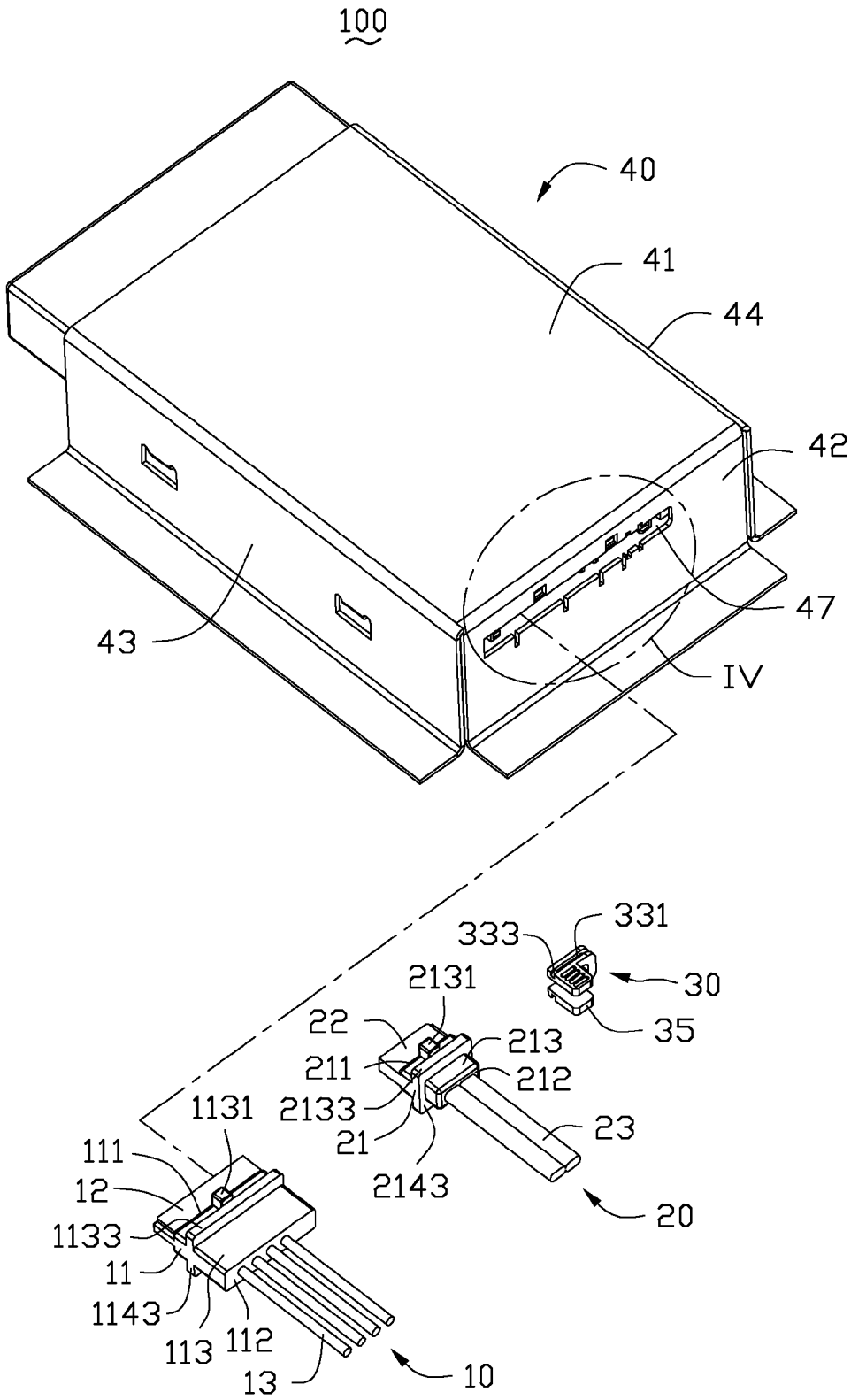
FIG. 1 is an exploded, isometric view of a cable connector assembly, according to an exemplary embodiment.
Figure 2:
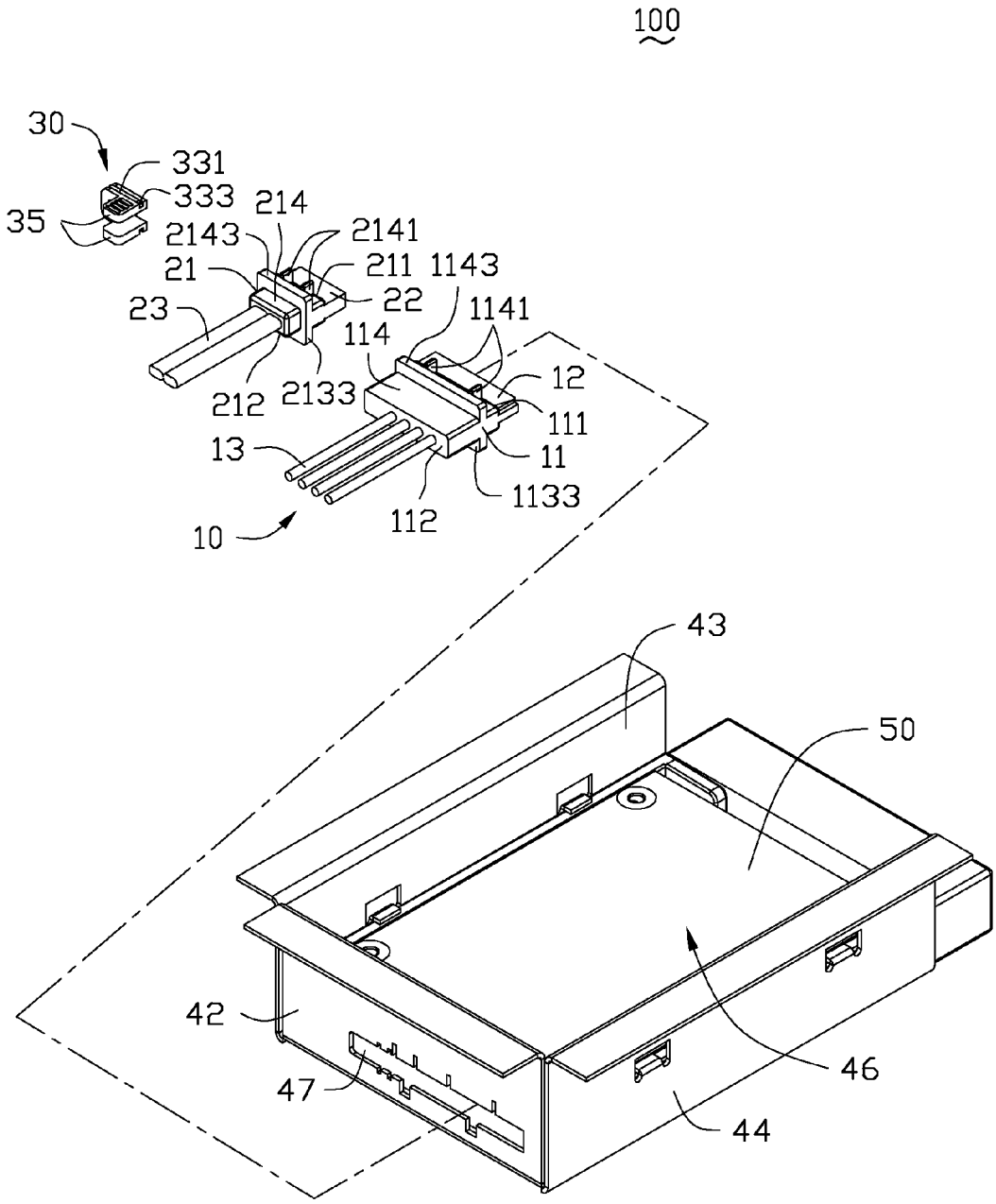
FIG. 2 is similar to FIG. 1, but viewing the cable connector assembly from another angle.

Referring to the FIGS. 1-2, a cable connector assembly 1, according to an exemplary embodiment, is shown. The cable connector assembly 1 includes a first cable connector 10, a second cable connector 20, a locking member 30, and a retaining frame 40.

The first cable connector 10 includes a first base portion 11, a first contact portion 12, and a plurality of power cables 13. The first base portion 11 is made of dielectric material and generally cuboid. The first base portion 11 includes a first end surface 111, a second end surface 112 opposite to the first end surface 111, a first mounting surface 113 perpendicular to the first end surface 111, and a second mounting surface 114 opposite to the first mounting surface 113. A first protrusion 1131 and a first limiting portion 1133 extend upward from the first mounting surface 111. The first protrusion 1131 is adjacent to the first end surface 111. The first limiting portion 1133 is generally rectangular and located between the first protrusion 1131 and the second end surface 112 and parallel to the second end surface 112. Two second protrusions 1141 and a second limiting portion 1143 extend upward from the second mounting surface 114. The second protrusions 1141 are adjacent to the first end surface 111. The second limiting portion 1143 is opposite to the first limiting portion 1133.

The first contact portion 12 penetrates into the base portion 11 through the first end surface 111. The power cable 13 penetrates into the base portion 11 through the second end surface 112. The first contact portion 12 is electrically connected to the power cables 13. In this embodiment, the first cable connector 10 is a serial advanced technology attachment (SATA) power connector for connecting to a hard disk drive 50 (HDD) and supplying power to the HDD 50.

The second cable connector 20 includes a second base portion 21, a second contact portion 22, and a plurality of data cables 23. The second base portion 21 is made of dielectric material and generally cuboid. The second base portion 21 includes a third end surface 211, a fourth end surface 212 opposite to the second end surface 211, a third mounting surface 213 perpendicular to the third end surface 211, and a fourth mounting surface 214 opposite to the third mounting surface 213. A third protrusion 2131 and a third limiting portion 2133 extend upward from the third mounting surface 213. The third protrusion 2131 is adjacent to the third end surface 211. The third limiting portion 2133 is generally rectangular and located between the third protrusion 2131 and the fourth end surface 212 and parallel to the fourth end surface 212. Two fourth protrusions 2141 and a fourth limiting portion 2143 extend upward from the fourth mounting surface 214. The fourth protrusions 2141 are adjacent to the third end surface 211. The fourth limiting portion 2143 is opposite to the third limiting portion 2133. The distance from the third mounting surface 213 to the fourth mounting surface 214 is equal to the distance from the first mounting surface 113 to the second mounting surface 114.

The second contact portion 22 penetrates into the second base portion 21 through the third end surface 211. The data cables 23 penetrate into the second base portion 21 through the fourth end surface 212. The second contact portion 22 is electrically connected to the data cables 23. In this embodiment, the second cable connector 20 is an SATA data connector for connecting to and transmitting data with the HDD 50.

Figure 3:
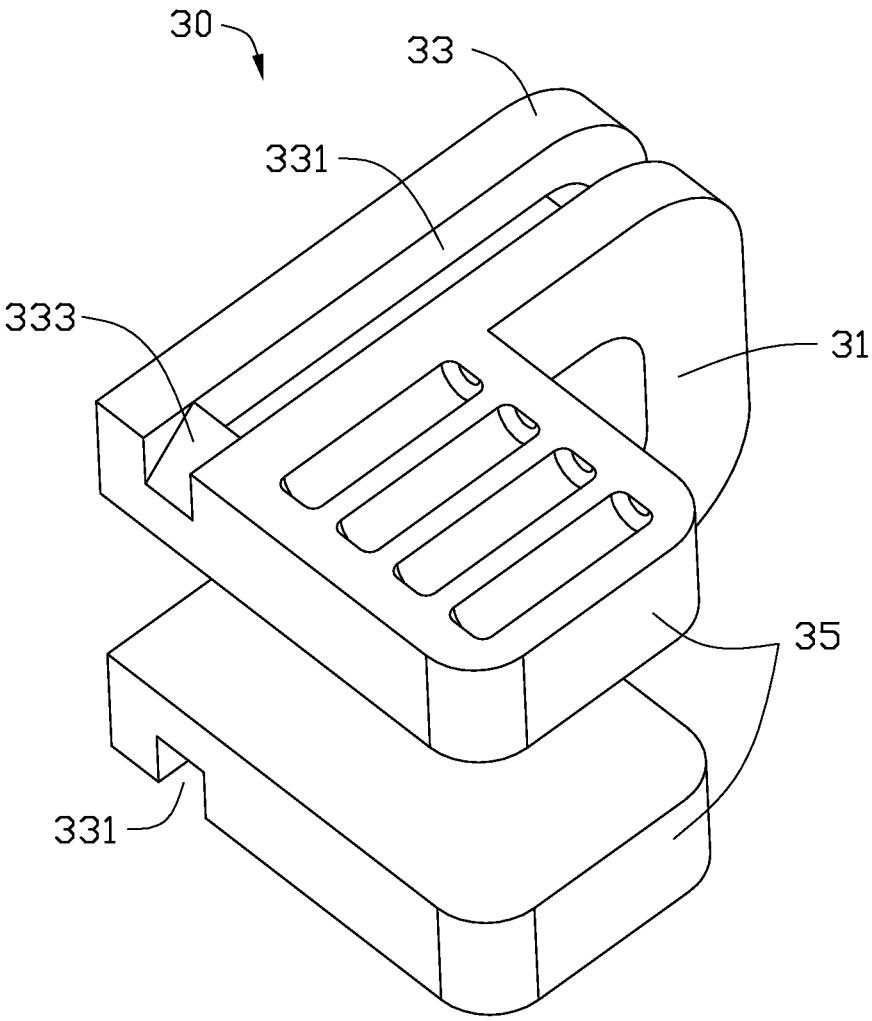
FIG. 3 is an isometric view of a locking member of the cable connector assembly of FIG. 1.

Referring to FIG. 3, the locking member 30 is made of dielectric elastic material. The locking member 30 is generally in a U shape and includes a main portion 31, a pair of arm portions 33, and a pair of pressing portions 35. The main portion 31 is generally a rectangular plate. The arm portions 33 extend from two ends of the main portion 31 along the same direction. The arm portions 33 are opposite to each other and the distance between the arm portions 33 is slightly greater than that of the first mounting surface 113 to the second mounting surface 114. Each arm portion 33 defines a receiving groove 331 extending along the direction which the arm portion 33 extends along. The two receiving grooves 331 are aligned with and away from each other. A hook 333 extends from a bottom surface of each receiving groove 331 adjacent to a distal end of each arm portion 33. The two hooks 333 are opposite to each other. Each pressing portion 35 is generally a plate and extends from one side of a corresponding arm portion 33 along a direction perpendicular to the arm portions 33. The pressing portions 35 are opposite to each other.

Figure 4:
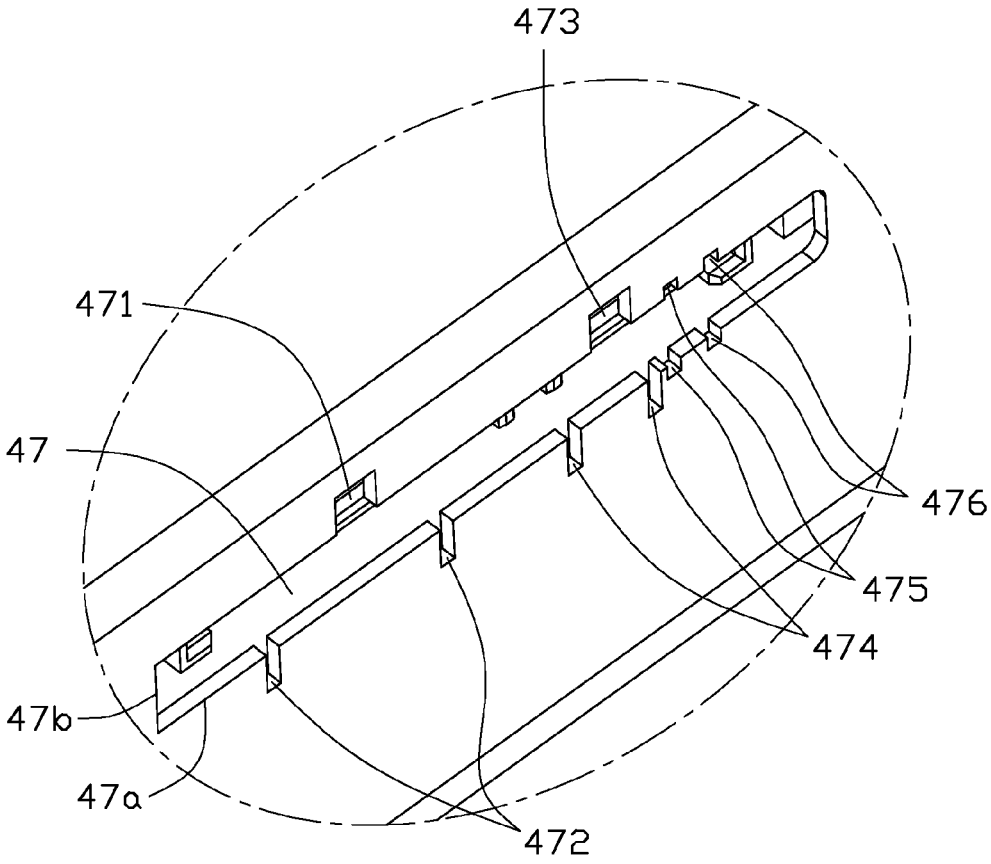
FIG. 4 is a partial enlarged view of a circled portion IV of the cable connector assembly of FIG. 1.

Referring to FIGS. 1, 2 and 4, the retaining frame 40 is made of metal and includes a top plate 41, a front wall 42, a first sidewall 43, and a second sidewall 44. The top plate is generally rectangular. The front wall 42 perpendicularly extends from one side of the top plate 41. The first sidewall 43 perpendicularly extends from the top plate 41 and perpendicular to the front wall 41. The second sidewall 44 is opposite to the first sidewall 43. The top plate 41, the front wall 42, the first sidewall 43, and the second sidewall 44 cooperatively define a receiving space 46 for receiving the HDD 50.

The front wall 42 defines a mounting hole 47 communicating with the receiving space 46. The mounting hole 47 is generally rectangular and includes a pair of lengthwise sides 47*a* parallel to the top plate 41 and a pair of widthwise sides 47*b* perpendicular to the lengthwise sides 47*a*. The width of each widthwise side 47*b* is equal to the distance from the first surface 113 to the second surface 114 and less than the distance between outer surfaces of the pair of arm portions 33 and greater than the distance between the receiving grooves 331. The front wall 42 defines a first notch 471, two second notches 472, a third notch 473, two fourth notches 474, a pair of first engaging recesses 475, and a pair second engaging recesses 476, all of them communicating with the mounting hole 47.

The first notch 471 is defined on one of the lengthwise sides 47*a* adjacent to the top plate 41. The first notch 471 spatially corresponds to the first protrusion 1131. The second notches 472 are defined on the other lengthwise side 47*a* away from the top plate 41, each of the second notches 472 spatially corresponds to a second protrusion 1141. The first notch 471 and the second notches 472 are adjacent to the first sidewall 43. The third notch 473 is defined on the lengthwise side 47*a* adjacent to the top plate 41. The third notch 473 spatially corresponds to the third protrusion 2131. The four notches 474 are defined on the lengthwise side 47*a* away from the top plate 41. Each of the four notches 474 spatially corresponds to a fourth protrusion 2141. The third notch 473 is adjacent to the first notch 471 and the fourth notches 474 are adjacent to the second notches 472. The first engaging recesses 475 are opposite to each other, and each engaging recess 475 is defined on a respective one of the lengthwise sides 47*a*. The second engaging recesses 476 are opposite to each other, and each engaging recess 476 is defined on a respective one of the lengthwise sides 47*a*. The second engaging recesses 476 are adjacent to the second sidewall 44. One of the first engaging recesses 475 is located between the third notch 473 and one of the second engaging recesses 476. The other first engaging recess 475 is located between the fourth notches 474 and the other second engaging recess 476. The first engaging recesses 475 and the second engaging recesses 476 both spatially correspond to the hooks 333.

Figure 5:
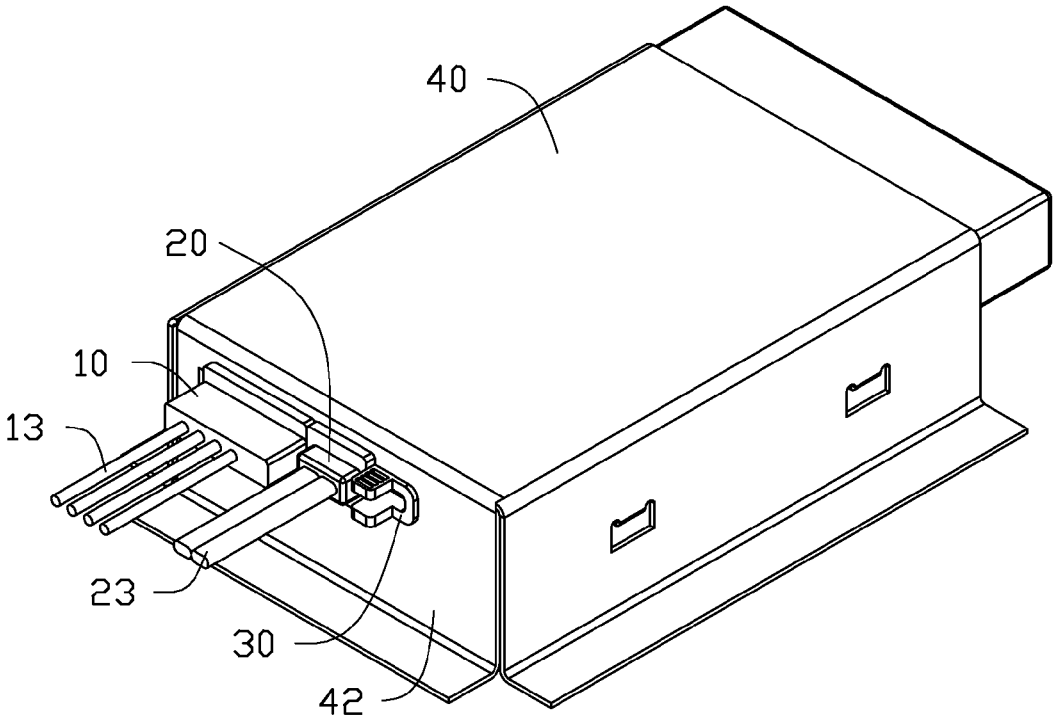
FIG. 5 is an isometric, assembled view in a first stage of the cable connector assembly of FIG. 1.
Figure 6:
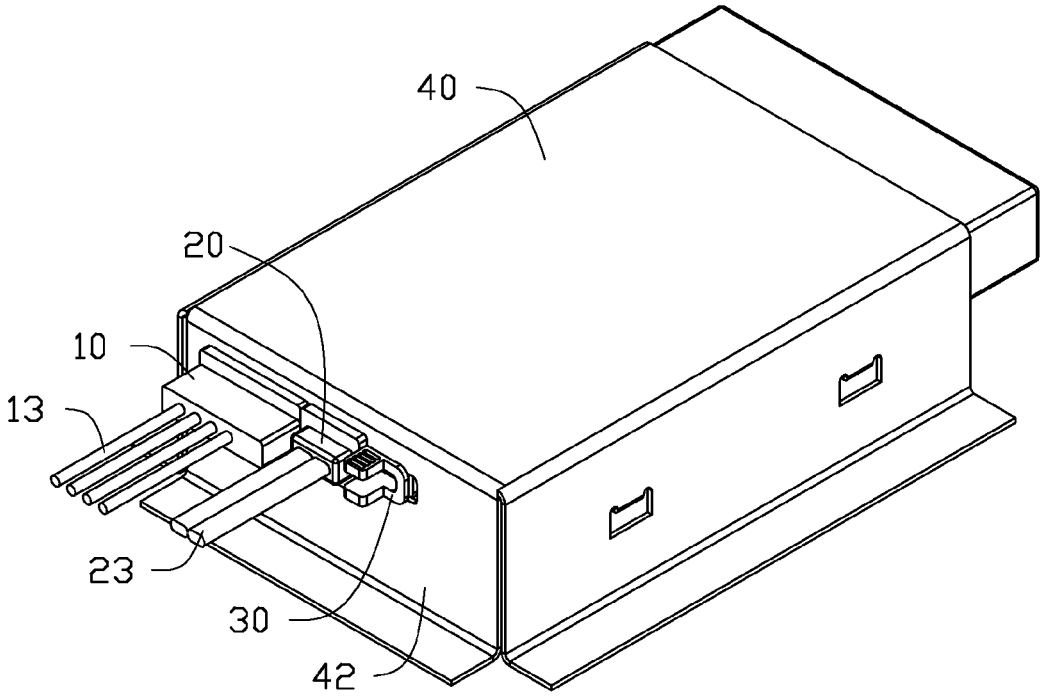
FIG. 6 is similar to FIG. 5, but in a second stage.

Referring to FIGS. 1, 5 and 6, when assembling, the pressing portions 35 are pressed to each other to make the distance between the arm portions 33 to be less than the width of each widthwise side 47*b*, the locking member 30 is clamped in the mounting hole 47 with the pair of lengthwise sides 47*a* received in the receiving grooves 331 and the two hooks 333 engaged with the second engaging recesses 476. The first base portion 11 is received in the mounting hole 47 with the first protrusion 1131 received in the first notch 471, the second protrusions 1231 received in the second notches 472, and the first limiting portion 1133 and the second limiting portion 1143 attaching on the exterior surface of the front wall 42. The first contact portion 12 is connected to the HDD 50. The second base portion 21 is received in the mounting hole 47 with the third protrusion 2131 received in the third notch 473, the fourth protrusions 2141 received in the fourth notches 474, and the third limiting portion 2133 and the fourth limiting portion 2143 attached on the exterior surface of the front wall 42. The second contact portion 22 is connected to the HDD 50. The second base portion 21 contacts the first base portion 11. The locking member 30 is at one side of the second base portion 21 and then slid to the second base portion 21 and presses on the second base portion 21 with the hooks 333 engaged with the first engaging recesses 475. The second base portion 21 presses on the first base portion 11, so the first connector 10 and the second connector can be steadily fixed on the retaining frame 40.

When disassembling, the pressing portions 35 are pressed towards each other, the locking member 30 is slid away from the second base portion 21 and then the hooks 333 engaged with the second engaging recesses 476. Then the first base portion 11 and the second base portion 21 are disconnected from the HDD 50 and taken out from the mounting hole 47.

The number of the first protrusion 1131, the second protrusion 1141, the third protrusion 2131, and the fourth protrusion 2141 is not limited to this embodiment.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A cable connector assembly, comprising:

a first cable connector comprising a first base portion;

a second cable connector comprising a second base portion;

a locking member; and a retaining frame comprising a front wall, the front wall defining a mounting hole;

wherein the first base portion and the second base portion are received in the mounting hole with the second base portion contacted to the first base portion, the locking member is detachably mounted in the mounting hole at one side of the second base portion, when the locking member is slid to the second base portion and pressing on the second base portion, the second base portion presses on the first base portion, the first base portion and the second base portion are locked in the mounting hole, wherein the locking member comprises a rectangular plate main portion, a pair of arm portions, and a pair of hooks; the arm portions extends from two ends of the main portion along the same direction, each arm portion defines a receiving groove extending along the direction which the arm portions extend along, the two receiving grooves are aligned with and face away from each other, each hook extend from a bottom surface of a correspond receiving groove adjacent to a distal end of each arm portion; the mounting hole is rectangular and comprises a pair of lengthwise sides and a pair of widthwise sides, each lengthwise side is received in a respective receiving groove, the lengthwise sides define a pair of opposite first engaging recesses adjacent to the second base portion, the hooks engage with the first engaging recesses when the locking member pressing on the second base portion.

2. The cable connector assembly of claim 1, wherein the first base portion comprises a first mounting surface and a second mounting surface, at least a first protrusion extending from the first mounting surface, and at least a second protrusion extending from the second mounting surface; the front wall defines at least a first notch and at least a second notch respectively receiving the at least a first protrusion and the at least a second protrusion, the at least a first notch and the at least a second notch communicate with the mounting hole.

3. The cable connector assembly of claim 2, wherein the number of the at least a first protrusion is different from that of the at least a second protrusion.

4. The cable connector assembly of claim 2, wherein the first base portion comprises one first protrusion and two second protrusions, the front wall defines one first notch and two second notches.

5. The cable connector assembly of claim 2, wherein the first base portion further comprises a first limiting portion extending from the first mounting surface and a second limiting portion opposite to the first mounting surface and extending from the second mounting surface; the first limiting portion and the second limiting portion attach on the front wall.

6. The cable connector assembly of claim 1, wherein the second base portion comprises a third mounting surface and a fourth mounting surface opposite to each other, at least a third protrusion extending from the third mounting surface, and at least a fourth protrusion extending from the fourth mounting surface; the front wall defines at least a third notch and at least a fourth notch respectively receiving the at least a third protrusion and the at least a fourth protrusion, the at least a third notch and the at least a fourth notch communicate with the mounting hole.

7. The cable connector assembly of claim 6, wherein the number of the at least a third protrusion is different from that of the at least a fourth protrusion.

8. The cable connector assembly of claim 6, wherein the first base portion comprises one first protrusion and two second protrusions, the front wall defines one third notch and two fourth notches.

9. The cable connector assembly of claim 6, wherein the second base portion further comprises a third limiting portion extending from the third mounting surface and a fourth limiting portion opposite to the third mounting surface and extending from the fourth mounting surface; the third limiting portion and the fourth limiting portion attach on the front wall.

10. The cable connector assembly of claim 1, wherein the lengthwise sides further define a pair of opposite second engaging recesses away from the second base portion relative to the first engaging recesses; the hooks engage with the second engaging recesses when the locking member is slid away from the second base portion.

11. The cable connector assembly of claim 1, wherein a distance between the pair of lengthwise sides is less than that of outer surfaces of the arm portions and greater than that of the receiving grooves.

12. The cable connector assembly of claim 1, wherein the locking member further comprises a pair of pressing portions, each pressing portion extends from a corresponding arm portion along a direction perpendicular to the arm portions.

13. The cable connector assembly of claim 1, wherein the locking member is made of dielectric elastic material.

14. The cable connector assembly of claim 1, wherein the first cable connector is an SATA power connector for connecting to a HDD and supplying power to the HDD.

15. The cable connector assembly of claim 1, wherein the second cable connector is an SATA data connector for connecting to the HDD and transmitting data with the HDD.

* * * * *